US009403632B1

(12) United States Patent
Ramos

(10) Patent No.: US 9,403,632 B1
(45) Date of Patent: Aug. 2, 2016

(54) FLUID DISPENSER

(71) Applicant: José Luis Marrero Ramos, Houston, TX (US)

(72) Inventor: José Luis Marrero Ramos, Houston, TX (US)

( * ) Notice: Subject to any disclaimer, the term of this patent is extended or adjusted under 35 U.S.C. 154(b) by 0 days.

(21) Appl. No.: 13/919,981

(22) Filed: Jun. 17, 2013

(51) Int. Cl.
*B67D 7/60* (2010.01)
*B65D 81/24* (2006.01)

(52) U.S. Cl.
CPC ..... *B65D 81/245* (2013.01)

(58) Field of Classification Search
CPC ..... B05B 11/0016; B05B 11/0018; B05B 11/0004; B65D 5/4295; B65D 81/245; B65D 83/62; B65D 47/32; A61J 2001/2072
USPC ..... 222/464.1–464.7, 478–489, 251–415, 222/320–321.9; 604/310, 311; 220/723; 215/307, 269
See application file for complete search history.

(56) References Cited

U.S. PATENT DOCUMENTS 987,970 A * 3/1911 Earl ..... B05B 11/3074 222/321.5
1,300,183 A * 4/1919 McLaughlin ..... 222/320
1,427,758 A * 8/1922 McLaughlin ..... A46B 11/0024 222/320
1,471,091 A 10/1923 Bessesen
1,602,354 A * 10/1926 Fowler ..... B01D 17/0214 126/377.1
1,783,419 A * 12/1930 Fitch ..... 222/309
1,810,135 A * 6/1931 Fitch ..... 222/282
1,854,458 A * 4/1932 De Quincy et al. ..... 222/215
1,977,360 A * 10/1934 Talbot ..... B67D 7/16 222/382
1,998,751 A * 4/1935 Creveling ..... 222/259
1,998,752 A * 4/1935 Creveling ..... F16N 3/12 222/259
2,268,592 A * 1/1942 Hothersall ..... F16N 37/02 137/533
2,286,797 A * 6/1942 Duerme ..... A61J 11/02 215/11.3
2,673,013 A * 3/1954 Hester ..... 222/386.5
2,684,182 A * 7/1954 Gey ..... 141/86
2,767,417 A * 10/1956 Amen ..... 401/9
2,810,496 A * 10/1957 Gray ..... 222/254
2,861,839 A * 11/1958 Mellon ..... 222/321.9
2,915,225 A * 12/1959 Atkins ..... 222/320
2,999,500 A * 9/1961 Schurer ..... 604/322
3,062,415 A * 11/1962 Anderson ..... B05B 11/3028 137/512.15
3,072,296 A * 1/1963 Isreeli ..... 222/132
3,319,837 A * 5/1967 Mueller ..... 222/212
3,343,701 A * 9/1967 Mahoney ..... 215/231

(Continued)

FOREIGN PATENT DOCUMENTS

EP 1849528 * 10/2007
GB 2202836 A * 10/1988 ..... B65D 47/32

(Continued)

*Primary Examiner* — Patrick M Buechner
*Assistant Examiner* — Randall Gruby
(74) *Attorney, Agent, or Firm* — IP Law Leaders PLLC; Raymond Ho; Cameron Tousi

(57) ABSTRACT

A fluid dispenser; in one non-limiting embodiment the fluid dispenser of the invention comprises: a housing, a hand pump, at least one bag, and a stem stabilizer. The housing defines an interior chamber and a housing wall. The housing wall defines at least one air-vent hole for ingress of air. The hand pump has a stem which extends downward into the interior chamber of the housing. The at least one bag is located in the interior chamber and is sealed except for being connected to the at least one air-vent hole. Negative pressure is created in the interior chamber when fluid is extracted from the interior chamber via the hand pump, this causes air to flow into the at least one air bag and thus the fluid inside the interior chamber is kept separate from the air entering the at least one air bag.

6 Claims, 13 Drawing Sheets

(56) References Cited

U.S. PATENT DOCUMENTS 3,360,168 A * 12/1967 Bret ..... 222/335
3,417,901 A * 12/1968 Sands ..... 222/95
3,584,770 A * 6/1971 Taylor ..... 222/479
3,592,365 A * 7/1971 Schwartzman ..... 222/209
3,767,078 A * 10/1973 Gortz et al. ..... 222/95
3,819,092 A * 6/1974 Bonduris ..... 222/389
3,949,906 A * 4/1976 Pettersen et al. ..... 222/153.13
3,987,941 A * 10/1976 Blessing ..... 222/386
3,989,165 A * 11/1976 Shaw et al. ..... 222/23
4,013,195 A 3/1977 Ferris
4,061,250 A * 12/1977 Tada ..... 222/321.8
4,077,442 A * 3/1978 Olofsson ..... 141/20
4,173,297 A * 11/1979 Pettersen ..... 222/321.2
4,259,954 A * 4/1981 Scott ..... 604/290
4,392,578 A * 7/1983 Fipp et al. ..... 215/231
4,420,100 A * 12/1983 Mueller ..... 222/205
4,470,526 A * 9/1984 Cha et al. ..... 222/320
4,630,759 A * 12/1986 Dawn ..... B67D 7/58 222/372
4,759,475 A * 7/1988 Munthe ..... 222/464.7
4,817,829 A * 4/1989 Fuchs ..... B05B 11/0051 141/27
4,817,830 A 4/1989 Yavorsky
5,156,300 A * 10/1992 Spahni et al. ..... 222/105
5,186,365 A * 2/1993 Nolte ..... B05B 15/005 137/320
5,267,673 A * 12/1993 Crosnier ..... B05B 11/0051 222/321.7
5,366,119 A * 11/1994 Kline ..... 222/180
5,464,129 A * 11/1995 Ho ..... 222/377
5,472,119 A * 12/1995 Park et al. ..... 222/145.8
5,499,758 A * 3/1996 McCann ..... B67D 1/045 222/386.5
5,667,110 A * 9/1997 McCann et al. ..... 222/386.5
5,772,079 A * 6/1998 Gueret ..... 222/321.7
D397,420 S * 8/1998 Campbell ..... D23/225
5,819,980 A * 10/1998 Hill ..... 220/719
6,364,163 B1 * 4/2002 Mueller ..... 222/83
6,769,576 B2 * 8/2004 Ichikawa ..... 222/321.5
6,942,123 B2 9/2005 Wertenberger
7,000,806 B2 2/2006 Py et al.
7,395,949 B2 * 7/2008 Ehret et al. ..... 222/386.5
7,644,841 B2 * 1/2010 Brainard ..... B05B 11/0072 222/211
7,967,037 B2 * 6/2011 Foster ..... F04B 15/02 141/104
8,357,137 B2 * 1/2013 Yandell ..... 604/414
8,434,647 B2 * 5/2013 Aamar ..... 222/207
2002/0111363 A1 * 8/2002 Drechsel et al. ..... 514/291
2003/0132252 A1 * 7/2003 Rossignol ..... 222/207
2005/0211795 A1 * 9/2005 Ueda et al. ..... 239/302
2009/0095776 A1 * 4/2009 Turner et al. ..... 222/386.5
2009/0261123 A1 * 10/2009 McNiff et al. ..... 222/39
2011/0240678 A1 * 10/2011 Keller et al. ..... 222/321.5
2012/0090730 A1 * 4/2012 Dumont et al. ..... 141/2
2012/0111894 A1 * 5/2012 Bakhos ..... 222/209
2012/0296306 A1 * 11/2012 Seifert et al. ..... 604/405
2013/0068796 A1 * 3/2013 Hui et al. ..... 222/256
2013/0306681 A1 * 11/2013 Muller et al. ..... 222/321.9
2014/0319182 A1 * 10/2014 Anzalone ..... B05B 11/3042 222/382

FOREIGN PATENT DOCUMENTS

GB 2424862 * 10/2006
WO WO 0007739 A1 * 2/2000
WO WO0240122 A2 5/2002
WO WO2011009154 A1 1/2011

* cited by examiner

| TABLE 1 | |
|---|---|
| Part # | |
| 100 | fluid dispenser 100 |
| 100i | industrial fluid dispenser 100i |
| 120 | housing 120 |
| 120i | industrial size housing 120i |
| 125 | top end 125 of housing 100 |
| 130 | base end 130 of housing 100 |
| 140 | hand pump 140 |
| 140i | fluid dispensing line 140i |
| 160 | at least one bag 160 |
| 160p | plurality of air bags 160p |
| 160pi | at least one industrial bag 160pi |
| 160s | single bag 160s |
| 170 | air bag opening 170 |
| 175 | adhesive 175 |
| 180 | interior chamber 180 of housing 120 |
| 200 | housing wall 200 |
| 210 | outer wall surface 210 of housing wall 200 |
| 215 | inner wall surface 215 of housing wall 200 |
| 215b | inner wall surface 215b at the base end 130 |
| 220 | at least one air-vent hole 220 |
| 220p | plurality of air-vent holes 220p |
| 220s | single air-vent hole 220s |
| 240 | stem 240 of hand pump 140 |
| 260 | stem stabilizer 260 |
| 260p | stem-stabilizer 260p |
| 262 | circular member 262 |
| 265 | through-hole 265 |
| 280 | fluid 280 |
| 280i | industrial fluid 280i |
| 300 | through hole 300 in stem stabilizer 260p for accommodating stem 240 |

*FIG. 12*

FLUID DISPENSER

CROSS-REFERENCE TO RELATED APPLICATIONS

Not applicable.

STATEMENT REGARDING FEDERALLY SPONSORED RESEARCH OR DEVELOPMENT

Not Applicable.

FIELD OF THE INVENTION

This invention relates to dispensers used for dispensing fluids such as, but not limited to, lotions such as skin lotions, and industrial fluids such as volatile organic compounds (VOCs) and lubricants.

BACKGROUND OF THE INVENTION

Fluids are often stored in vessels from which they are intermittently dispensed. Fluids include chemical compositions some of which are vulnerable to oxidation upon prolonged contact with air present in the environment. Some fluids are chemical compositions which include volatile organic components which have a tendency to evaporate or otherwise escape from containers in which they are stored and from which they are dispensed. There is a continual need for ways to reduce fluid exposure to air.

World Intellectual Property Organization (W.I.P.O.) Patent Application Number WO0240122A2 and U.S. Pat. No. 7,000,806 each disclose a dispenser for dispensing a fluid that includes a rigid vial with a main fluid chamber containing a fluid, and a pump assembly that is in fluid communication with the main fluid chamber and is configured to dispense a predetermined quantity of fluid from the main fluid chamber. A flexible bladder is provided which is located within the main fluid chamber and is configured to expand to fill the ullage created within the main fluid chamber during dispensing of fluid by the pump assembly. The resilient bladder tends to force itself outwardly toward the rigid vial and, in turn, increases the pressure within the main fluid chamber in comparison to the interior of the bladder to thereby prevent the ingress of air or vapors through the bladder or otherwise into the main fluid chamber.

U.S. Pat. No. 4,817,830 discloses an improved thin-walled pressure vessel having a bladder therein. This vessel includes a shell having an opening and a spout disposed around the opening. An improved cap normally closes this opening, secures the bladder to the shell of the vessel, and provides communication between the outside of the vessel and the inside of the bladder. The cap member comprises a main body member having an opening which receives a valve member. This valve member extends out through one end of the cap member. It also extends through the opposite end of the cap and into the bladder through an opening in the bladder. The valve member engages a portion of the bladder around the opening and clamps this portion against the main body member to secure the bladder to the cap member. As the pressure in the bladder increases, it forces the valve member further against the walls of the opening in the main body member, increasing the clamping force to firmly secure the bladder to the cap member.

None of the above inventions and patents, taken either singly or in combination, is seen to describe the instant invention as claimed.

SUMMARY OF THE INVENTION

A fluid dispenser for dispensing fluids such as, but not limited to, cosmetic lotions or industrial fluids such as, but not limited to, paint. In one non-limiting embodiment the fluid dispenser of the invention comprises: a housing, a hand pump, at least one bag, and a stem stabilizer. The housing defines an interior chamber and a housing wall. The housing wall defines at least one air-vent hole for ingress of air. The hand pump has a stem which extends downward into the interior chamber of the housing. The at least one bag is located in the interior chamber and is sealed except for being connected to the at least one air-vent hole such that each air-bent hole has a bag connected to it and air is prevented from entering the interior chamber except for the air that enters the at least one air bag. Negative pressure is created in the interior chamber when fluid is extracted from the interior chamber via hand pump, this causes air to flow into the at least one air bag and thus the fluid inside the interior chamber is kept separate from the air entering the at least one air bag.

BRIEF DESCRIPTION OF THE DRAWINGS

FIG. 12 shows a table (Table 1) that lists reference numbers and their associated descriptions.

Similar reference characters denote corresponding features consistently throughout the attached drawings.

DETAILED DESCRIPTION OF THE PREFERRED EMBODIMENTS

Figure 1:
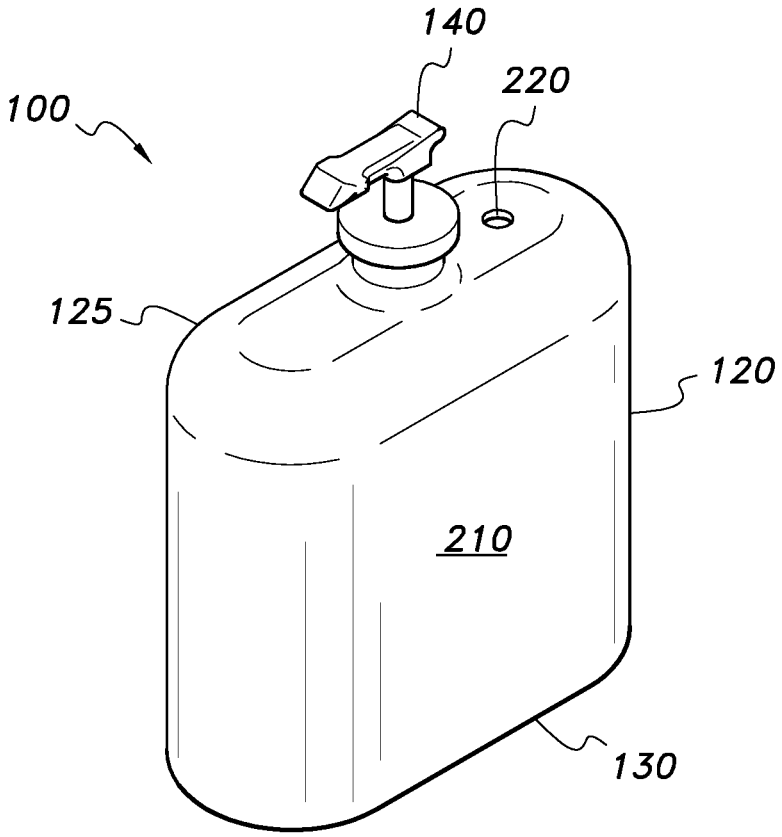
FIG. 1 is a perspective view of a fluid dispenser, according to the present invention.
Figure 1A:
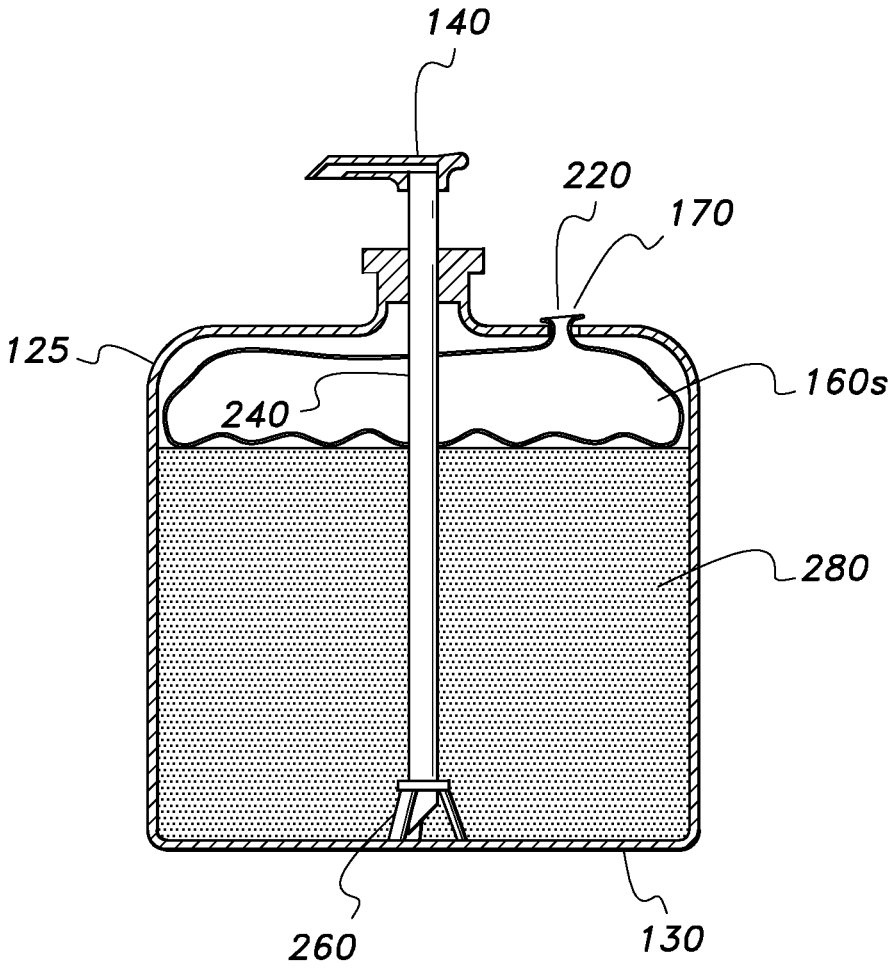
FIG. 1A is a cross-section view of a fluid dispenser, according to the present invention.
Figure 2:
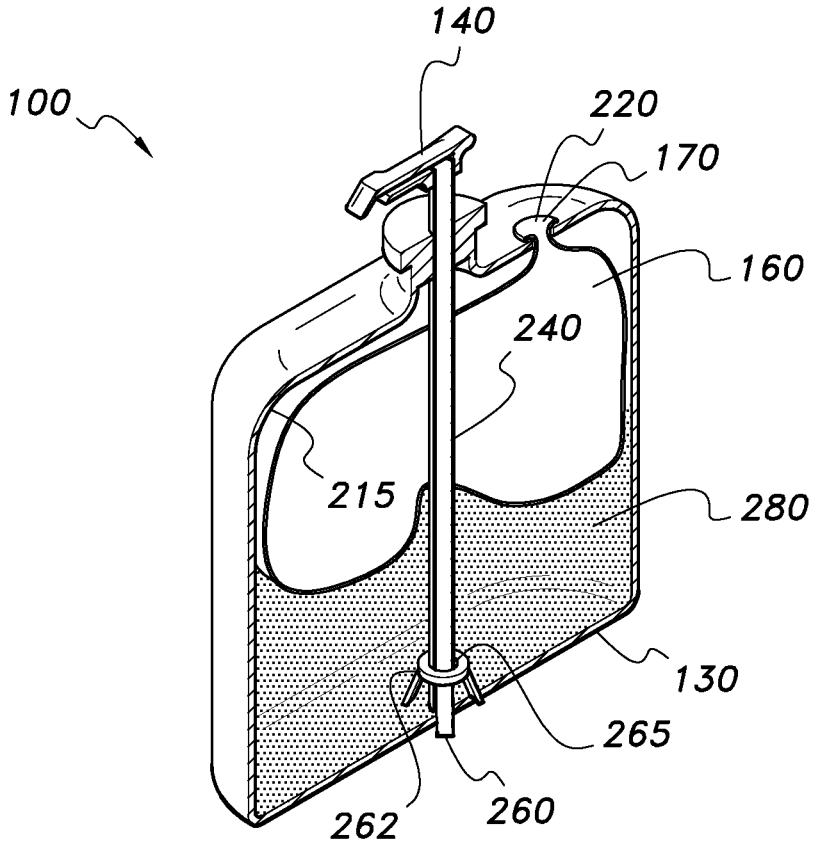
FIG. 2 is perspective front section view of a fluid dispenser having a single air bag, according to the present invention.
Figure 3:
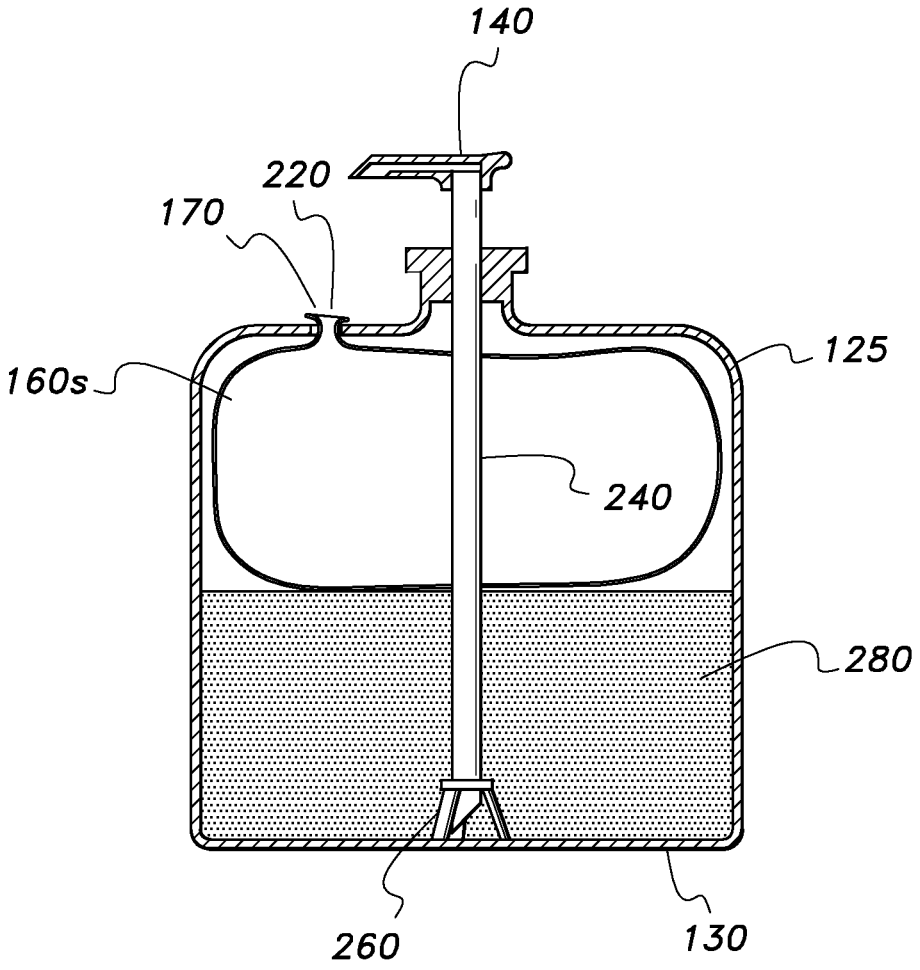
FIG. 3 is a rear perspective view of the fluid dispenser shown in FIG. 2.

This invention is directed to dispensers used for dispensing fluids such as, but not limited to, lotions such as skin lotions, and industrial fluids such as volatile organic compounds (VOCs) and lubricants.

It is to be understood that the terms “top”, “bottom”, “side”, “front”, “rear”, “upper”, “lower”, “vertical”, “horizontal”, “height”, “width”, “length” and the like are used herein merely to describe points of reference and do not limit the present invention to any specific orientation or configuration. The claimed apparatus and components may be of any size, shape or configuration suitable for operation of the apparatus and may be constructed of any suitable materials.

Referring to the Figures in general, a summary of the component parts are listed in Table 1 (see FIG. 12).

The fluid dispenser of the invention is denoted generally by the numeric label "100". The fluid dispenser 100 comprises a housing 120, a hand pump 140, and at least one bag 160. The hand pump 140 can be any suitable hand pump such as, but not limited to, a hand pump used in NIVEA® "Original Moisture Daily Lotion" dispensers; also such as, but not limited to, a hand pump used in Softsoap® clean Protection™ "WASH AWAY BACTERIA" dispensers distributed by COLGATE-PALMOLIVE Company of New York, N.Y., USA.

The housing 120 has a top end 125, a base end 130, an interior chamber 180, and a housing wall 200; the housing wall 200 defines an outer wall surface 210 and an inner wall surface 215. The housing wall 200 defines at least one air-vent hole 220 for ingress of air into the at least one bag 160. The at least one air-vent hole 220 extends through the housing wall 200 between outer and inner housing wall surfaces 210 and 215. The hand pump 140 includes a stem 240; the stem 240 defines an outer stem diameter 250. The stem 240 is in communication with the interior chamber 180; for example, in FIG. 6 the stem 240 is shown extending downward into the interior chamber 180 of housing 100. The housing 100 can be made of any suitable material such as, but not limited to, plastic. The plastic can be translucent, transparent or opaque. The housing 120 can be made of glass. The glass can be translucent, transparent or opaque. Indicia can be printed directly to the outer wall surface 210 of housing wall 200; decals can also be applied to the outer wall surface 210 of housing wall 200. The hand pump 140 can also be made of plastic.

Figure 11:
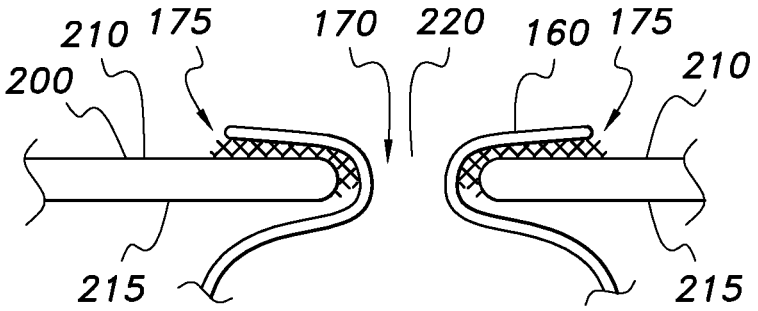
FIG. 11 is an enlarged section view of a fluid dispenser, according to the invention.

The at least one bag 160 has an opening 170 which is aligned with the at least one air-vent hole 220. The opening 170 can be in sealed engagement with the surrounding surface of the at least one air-vent hole 220. For example, the bag opening 170 can be affixed in air-tight engagement around the at least one air-vent hole 220 using a suitable adhesive 175 (see FIG. 11). The hand-pump 140 is in air-tight sealed engagement with respect to the top end 125 of the housing; this can be achieved by any suitable means such as ultra-sonic welding.

The at least one bag 160 has sufficient volume capacity to ensure that the at least one bag 160 can hold a sufficient amount of air (received by the at least one air-vent hole 220) to ensure fluid 280 can be extracted easily by hand-pump 140.

A stem stabilizer 260 helps the stem 240 resist possible sideways pressure when the at least one air bag 160 fills with air and presses against the stem 240. The stem stabilizer 260 can take any suitable form. The stem stabilizer 260 shown for example in FIG. 4 extends upward from the base end 130 of housing 100. The stem stabilizer defines a circular member 262 which in turn defines through-hole 265; the through-hole 265 has a sufficient bore to accommodate the width of the stem 240. The through-hole 265 of the stem stabilizer 260 secures the stem 240 such that the stem 240 can resist sideways forces that might otherwise cause the stem 240 to flex and hence effectively shorten its operating length inside the interior chamber 180 thereby rendering it harder to extract fluid 280 from the base end 130 via the stem 240 in response to a user (not shown) applying reciprocal motions to the hand pump 140.

Figure 9:
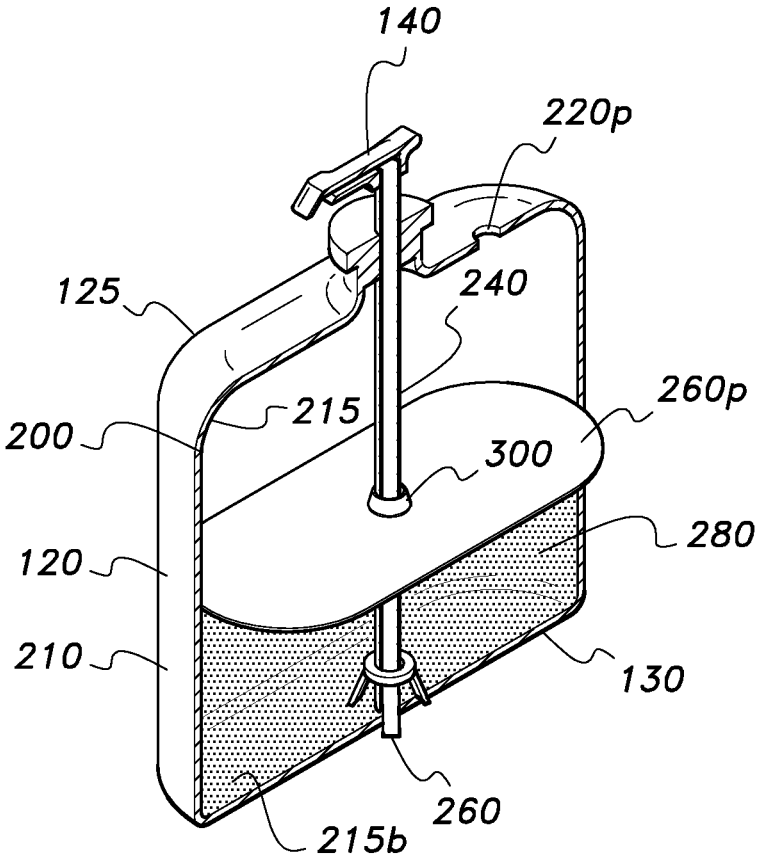
FIG. 9 is a perspective view of a fluid dispenser, according to the present invention.

Also, the stem stabilizer can be of substantially planar construction with a through-hole 300 disposed therein; the through-hole 300 being of sufficient dimensions to allow the stem 240 to be secured by the through-hole 300. Such an arrangement is shown in FIG. 9 where the planar stem stabilizer is labeled 260*p*. The stem stabilizer 260*p* can be used alone. In the alternative, the stem stabilizer 260*p* can be used in combination with the stem stabilizer 260 as shown in FIG. 9.

During normal operation the fluid dispenser 100 creates negative pressure in the interior chamber 180 thereby causing air to be drawn into the at least one air bag 160 without coming into contact with a fluid 280 inside the chamber 180. For example, FIGS. 1A through 4 show how one non-limiting embodiment of the fluid dispenser 100 works; a user typically uses their hand (not shown) to apply pressure to the top of a hand pump 140 which forces fluid (such as, but not limited to, anti-bacterial liquid soap) to flow from the interior chamber 180 to the exterior of the fluid dispenser 100 via stem 240. The forced fluid extraction from the interior chamber 180 causes negative pressure in chamber 180 which in turn causes air to enter the at least one bag 160 via at least one air-vent hole 220. In FIGS. 1A through 4*j* only a single bag is shown (labeled as 160*s* in FIG. 4) and the single air-vent hole 220*s*. The stem stabilizer 260 ensures that the stem 240 remains in a vertical configuration as the air bag 160*s* inflates.

Figure 4:
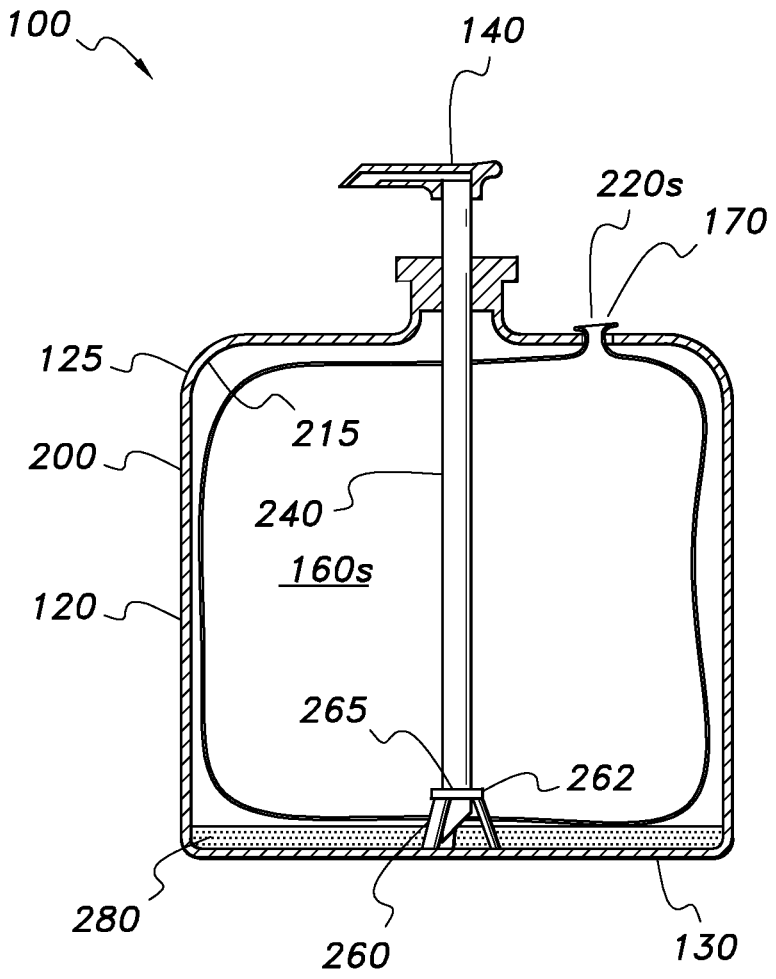
FIG. 4 is a cross-section view of a fluid dispenser, according to the present invention.
Figure 5:
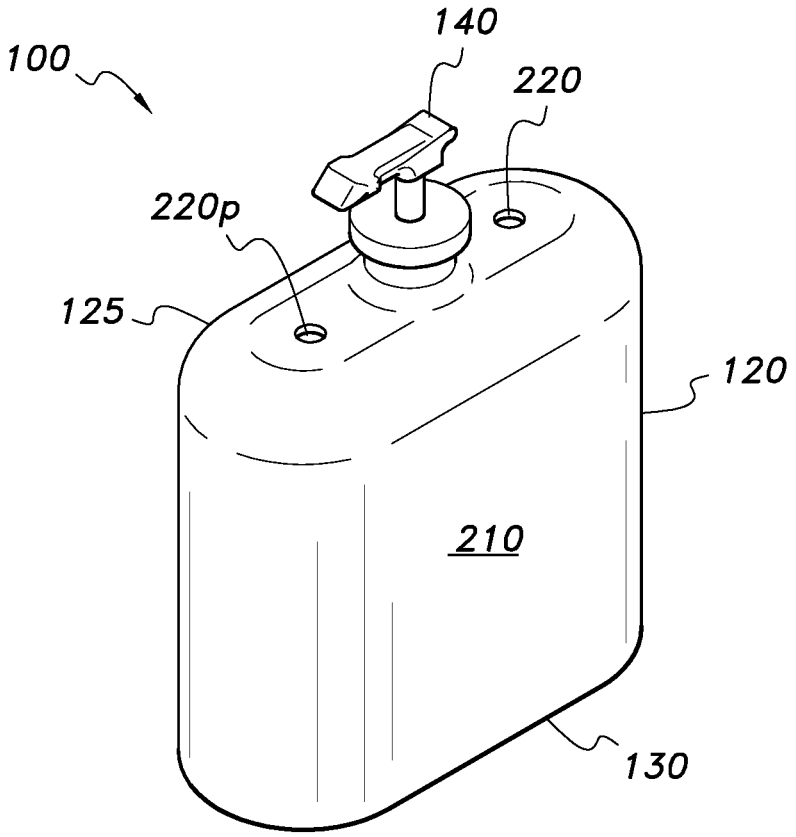
FIG. 5 is a perspective view of a fluid dispenser, according to the present invention.

In the example as shown in FIG. 4, the stem stabilizer 260 has the circular member 262 with supporting legs for securing the circular member 262 to the housing 120.

Figure 6:
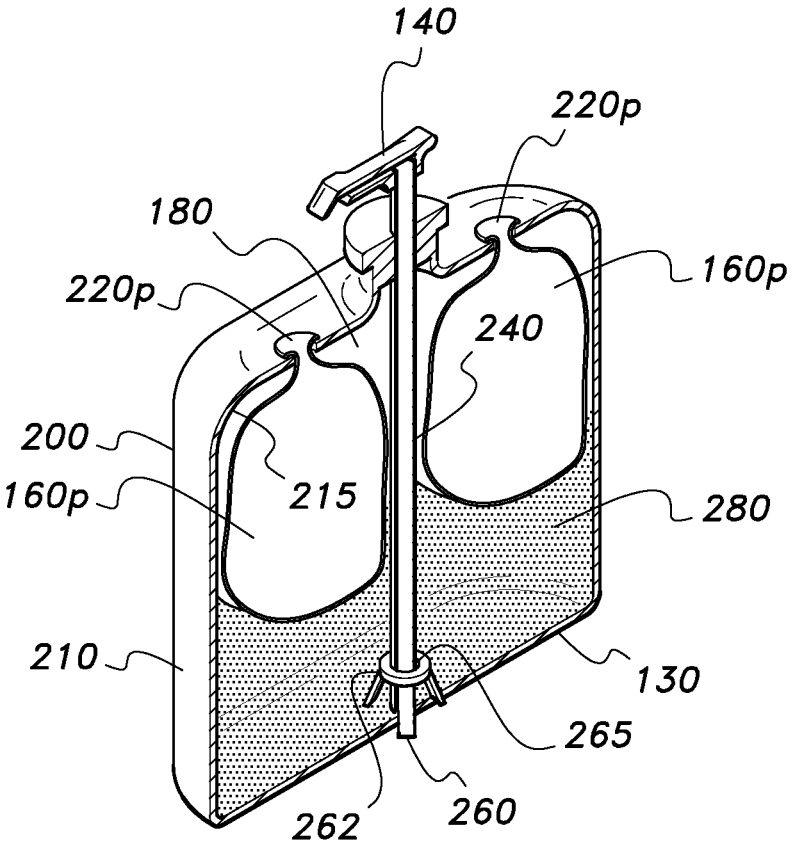
FIG. 6 is perspective front section view of a fluid dispenser having two air bags, according to the present invention.
Figure 7:
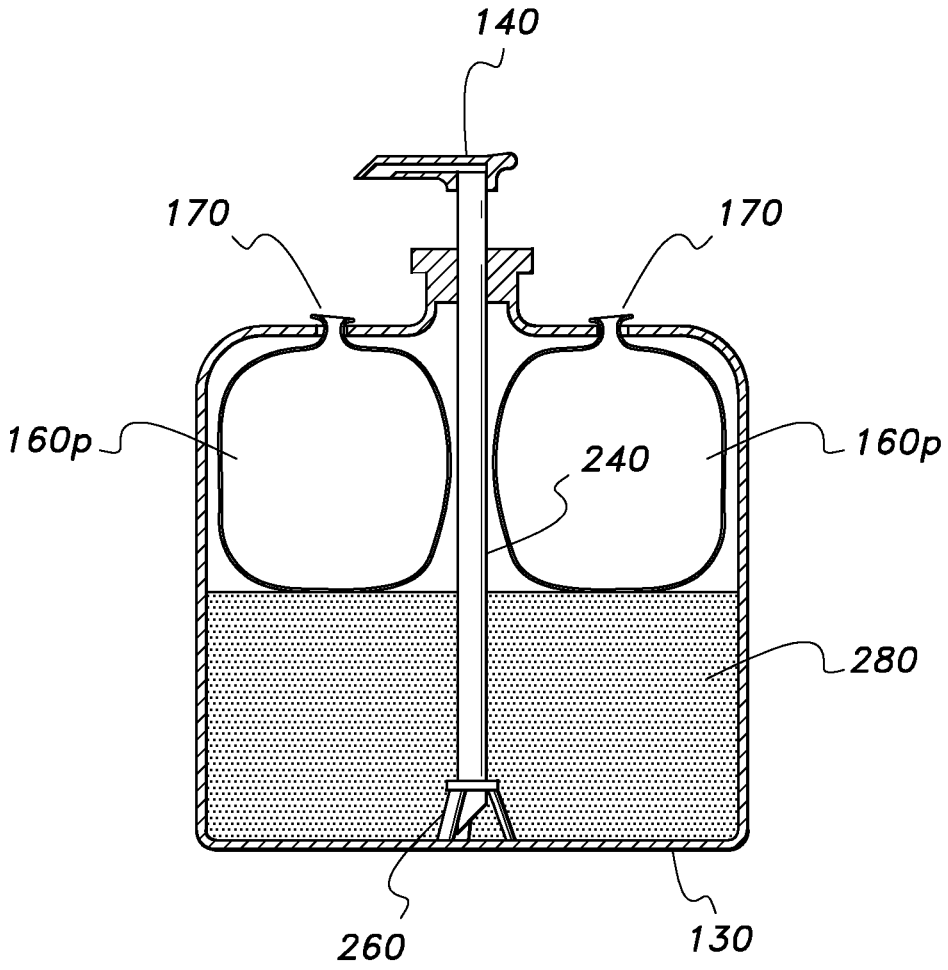
FIG. 7 is front section view of a fluid dispenser having two air bags, according to the present invention.
Figure 8:
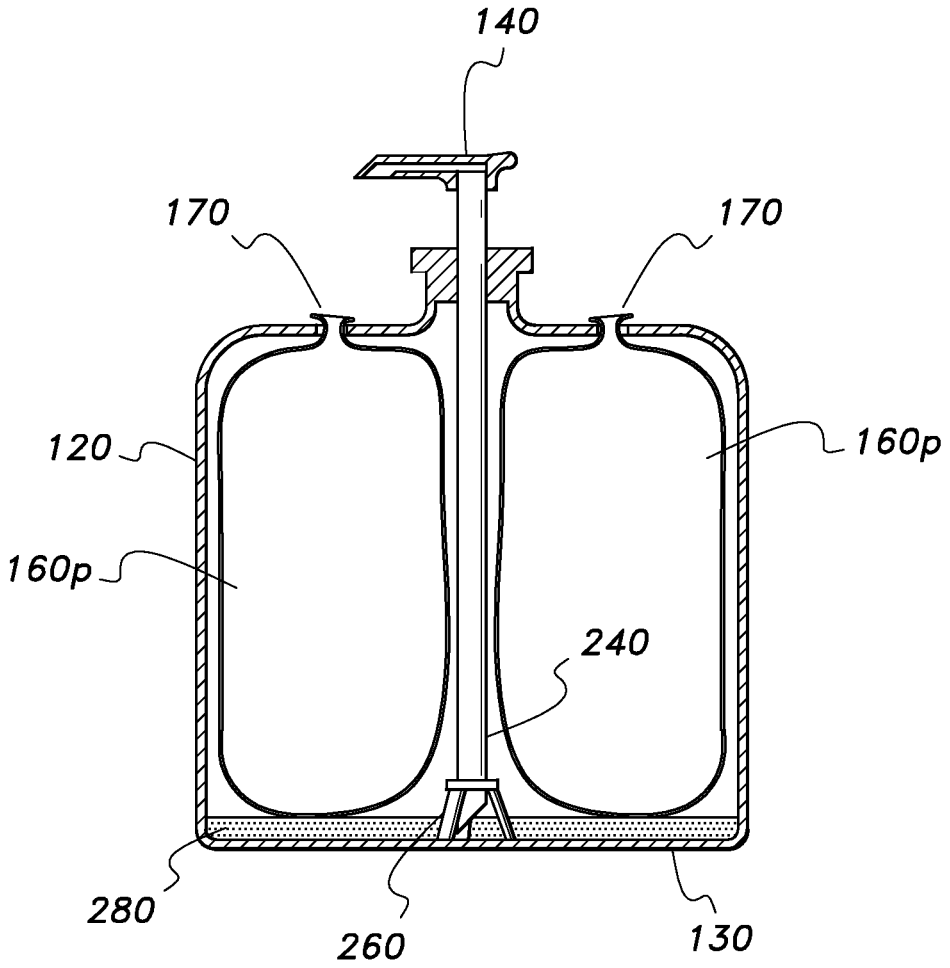
FIG. 8 is front section view of a fluid dispenser having two air bags, according to the present invention.

FIGS. 6 through 8 show how one non-limiting embodiment of the fluid dispenser 100 works; a user typically uses their hand (not shown) to apply pressure to the top of a hand pump 140 which forces fluid (such as, but not limited to, anti-bacterial liquid soap) to flow from the interior chamber 180 to the exterior of the fluid dispenser 100 via stem 240. The forced fluid extraction from the interior chamber 180 causes negative pressure in chamber 180 which in turn causes air to enter a plurality of air bags 160*p* via at least one air-vent hole 220. In FIGS. 6 through 8 only two bags are shown (labeled as 160*p*) and the two air-vent holes are labeled 220*p*. The stem stabilizer 260 ensures that the stem 240 remains in a vertical configuration as the air bags 160*p* inflate.

Figure 10:
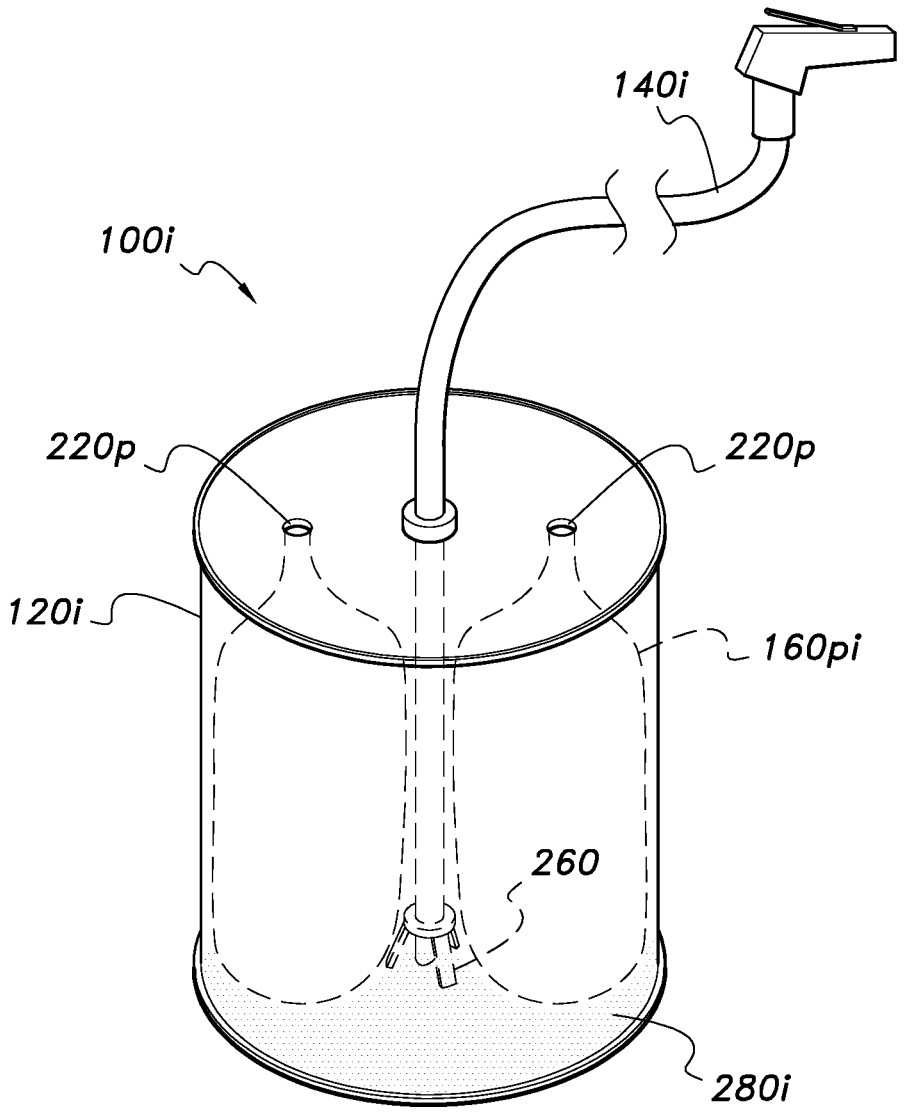
FIG. 10 is a perspective view of an industrial fluid dispenser, according to the present invention.

In a further embodiment, the invention is an industrial size fluid dispenser 100*i* (see FIG. 10) made up of a housing 100*i*, fluid dispensing line 140*i*, and at least one industrial sized bag 160*pi*. The at least one industrial sized bag 160*pi* which upon full deployment has a volume capacity of the industrial size bag being at least 2 gallons; and preferably between 2 and 25 gallons. An industrial fluid 280*i* such as, but not limited to, lubricating oil can be dispensed from the industrial size housing 120*i* via fluid dispensing line 140*i*. An industrial size fluid dispenser 100*i* is defined herein as fluid dispenser having the capacity to dispense at least 5 gallons of fluid. The fluid capacity of the fluid dispenser 100*i* can be between 5 gallons and 200 gallons of fluid. For example, the housing 120*i* could be a 50 gallon drum. Industrial fluids that can be dispensed by fluid dispenser 100*i* include, but are not limited to, volatile organic solvents (VOCs). The volume term "gallon" defined as being equal to 3.8 L (i.e., 3.8 liters, to one decimal place; the European spelling of "liters" is: "liters").

The invention being thus described, it will be evident that the same may be varied in many ways by a routineer in the applicable arts. Such variations are not to be regarded as a departure from the spirit and scope of the invention.

What is claimed:

1. A fluid dispenser, comprising:

a housing, said housing defining an interior chamber, said housing defining a housing wall, said housing wall defining an air-vent hole for ingress of air;

a hand pump having a stem, said stem being in communication with said interior chamber of said housing;

a bag, said bag being located in said interior chamber of said housing, said bag being sealed except for a connection between said bag and said air-vent hole such that said bag can receive air via said air-vent hole, wherein during normal operation said hand pump creates negative pressure in said interior chamber which causes air to ingress into said air bag via said air-vent hole; and a first stem stabilizer for stabilizing said stem such that said stem is prevented from being forced sideways when said air bag fills with air, and wherein the first stem stabilizer is substantially planar and of a substantially similar cross sectional shape as the interior chamber of said housing.

2. The fluid dispenser according to claim 1, wherein said first stem stabilizer is of substantially planar construction with a hole disposed in said first stem stabilizer for accommodating the width of said stem of said hand pump.

3. The fluid dispenser according to claim 1, wherein said housing defines a base end, and wherein the fluid dispenser further comprises:

a second stem stabilizer that extends upward from the base end of the housing, and wherein said second stem stabilizer defines a circular member which in turn defines a through-hole, and further wherein said through-hole has a sufficient bore to secure said stem.

4. The fluid dispenser according to claim 1, wherein the first stem stabilizer is adapted to slidingly and sealingly engage an interior wall portion of the interior chamber such that the fluid remains below the stem stabilizer.

5. A fluid dispenser, comprising a housing, said housing defining an interior chamber, said housing defining a housing wall, said housing wall defining first and second air-vent holes for ingress of air;

a hand pump having a stem, said stem being in communication with said interior chamber of said housing;

a first bag and a second bag, said first and second bags being located in said interior chamber of said housing, wherein said first and second bags are connected respectively with first and second air-vent holes; and a stem stabilizer, said stem stabilizer being of substantially planar construction with a hole disposed in said stem stabilizer for accommodating said stem of said hand pump, and wherein the stem stabilizer is of a substantially similar shape as the interior chamber of said housing.

6. The fluid dispenser according to claim 5, wherein the stem stabilizer is adapted to slidingly and sealingly engage an interior wall portion of the interior chamber such that the fluid remains below the stem stabilizer.

* * * * *